United States Patent [19]

Mesnard

[11] Patent Number: 4,842,140

[45] Date of Patent: Jun. 27, 1989

[54] NOVELTY MAILER

[76] Inventor: Curtis L. Mesnard, 4118 59th St., West, Bradenton, Fla. 33529

[21] Appl. No.: 122,213

[22] Filed: Nov. 18, 1987

[51] Int. Cl.[4] ..... G09F 3/00; B65D 79/00

[52] U.S. Cl. ..... 206/457; 40/311; 215/355; 206/459

[58] Field of Search ..... 206/457, 459; 215/355-364; 229/921; 40/310, 311

[56] References Cited

U.S. PATENT DOCUMENTS

| | | | |
|---|---|---|---|
| 197,595 | 11/1877 | Brown | 206/457 |
| 840,105 | 1/1907 | Blocki | 40/310 X |
| 1,743,980 | 1/1930 | Samson | 229/921 X |
| 3,590,989 | 7/1971 | Wittwer | 206/459 |
| 3,841,053 | 10/1974 | Weatherhead, III et al. | 206/457 |
| 4,600,102 | 7/1986 | Avila | 206/457 |

*Primary Examiner*—William Price
*Attorney, Agent, or Firm*—Charles J. Prescott

[57] ABSTRACT

A novelty mailer for mailing correspondence and parcels by either civil or commercial postal services. The novelty mailer includes a shatterproof thin-wall container, preferably transparent, which has an opening through which both a written message or parcel and decorations may be passed therethrough. The opening is then closable and a mailing label connectable to the outer surface of the container may be addressed and posted for delivery. The decorations are preferably materials which identify a region and may include a decorative label of a region, while the closure means may be a stopper or closable lid. The closure means may also be sealed after being closed in or over the opening to provide visible indicia of unauthorized tampering.

3 Claims, 2 Drawing Sheets

Fig. 6
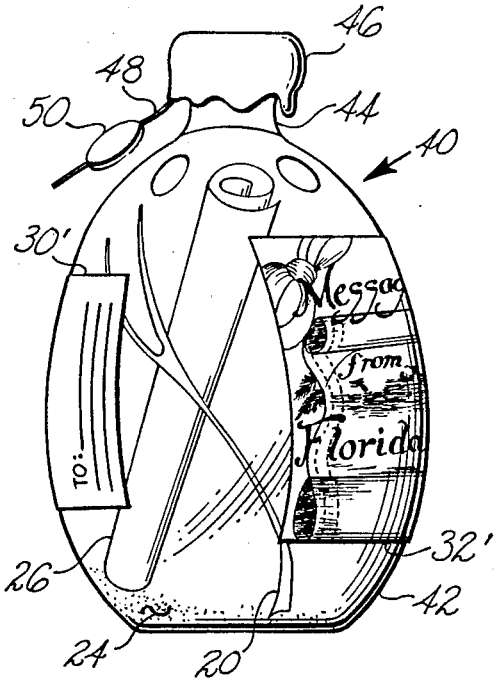
Fig. 7
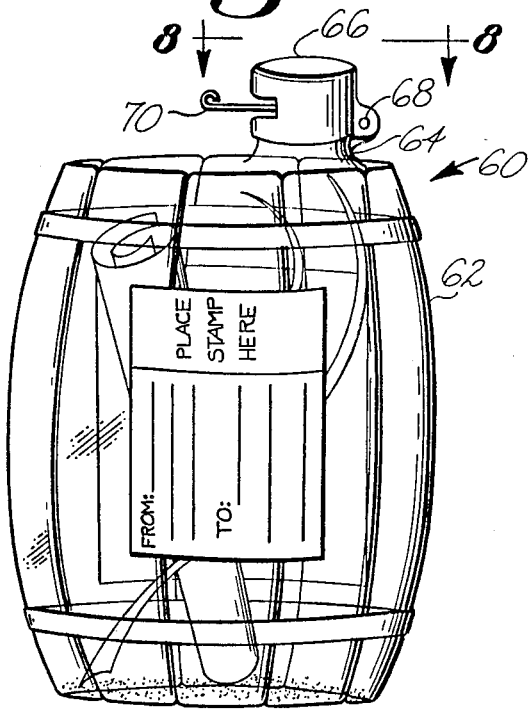
Fig. 8
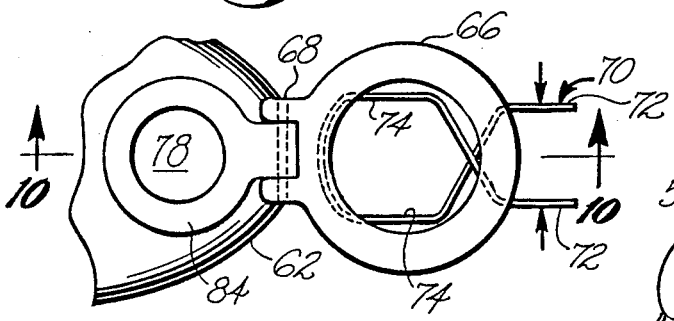
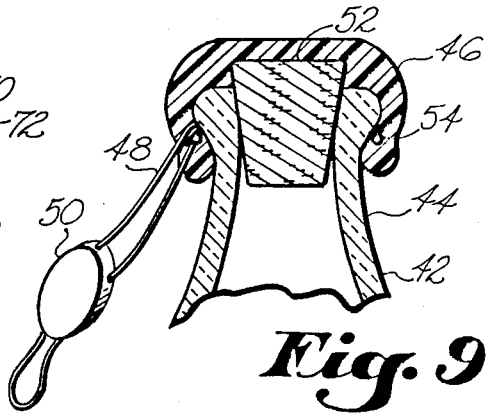
Fig. 9
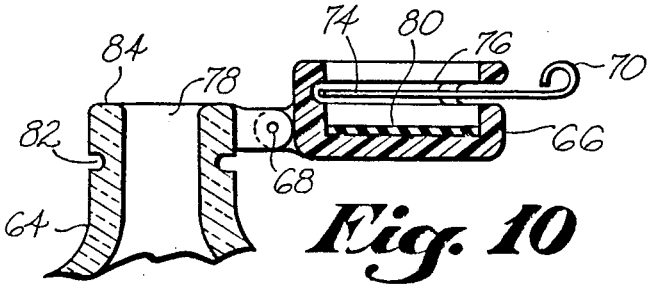
Fig. 10

NOVELTY MAILER

BACKGROUND OF THE INVENTION

This invention relates generally to means for mailing and snipping correspondence and parcels, and more particularly to a novelty mailer for accomplishing the same.

Many products are commercially available for mailing correspondence and parcels by either civil or commercial entities. Beyond the conventional cardboard and paper envelopes packaging, applicant is aware of padded bags for enhanced protectability of the contents thereof, along with rigidized container shapes such as tubular packages for conveying rolled paper products and the like.

Additionally, applicant is aware of the mailer for biological specimens as disclosed in U.S. Pat. No. 3,819,081 to Runtee comprising a sample receiving inner tube interconnected via end caps an outer protective tube for shipping.

Additionally, applicant is aware of a number of decorative devices for other uses such as in U.S. Pat. No. 2,300,473 to Vanwinkle for an ornamental display/container structure, in U.S. Pat. No. 2,329,375 to Houlihan for a decorative tubing casing for such articles as lipstick holders and other similar cosmetic holders, flashlights and the like and in U.S. Pat. No. 4,457,103 to Aloziem for a decorative pottery structure having a glass outer layer, colored sand or silt as a middle layer, and an inner layer of Plaster of Paris.

No other structures known to applicant are available to provide any form of "novelty" mailers for enhanced merchandising of same and/or for providing the unusual mode of conveying greetings and parcels to another by either civil or commercial carriers.

The present invention provides such a novelty-type mailer which is particularly adapted to be available in gift shops and other retail outlets and through mail and parcel carriers to those who may be vacationing in a particular region and/or wish to convey not only a written message or parcel to someone but also wishes to utilize the mode of conveyance as a novelty means of sharing the experience of being in a remote region during travel or vacation or simply utilizing a unique form of expression.

BRIEF SUMMARY OF THE INVENTION

The present invention is directed to a novelty mailer for mailing correspondence and parcels by either civil or commercial postal services. The novelty mailer includes a shatterproof thin-wall container, preferably transparent, which has an opening through which both a written message or parcel and decorations may be passed therethrough into the container. The opening is then closable and a mailing label connectable to the outer surface of the container may be addressed and posted for delivery. The decorations are preferably materials which identify a region and may also include a decorative label of a region, while the closure means may be a stopper or closable lid. The closure means may also be sealed after being closed in or over the opening to provide visible indicia of unauthorized tampering.

It is therefore an object of this invention to provide a novelty mailer which may be utilized to convey messages and parcels via civil and commercial carriers.

It is another object to provide the above invention to include inherent means for expressing and sharing travel experiences of regions of the world.

It is yet another object to provide the above invention having structural features which render the invention acceptable for conveyance by civil and commercial carriers.

It is yet another object to provide the above invention having sealing means for providing visible indicia of unauthorized tampering with the contents thereof.

In accordance with these and other objects which will become apparent hereinafter, the instant invention will now be described with reference to the accompanying drawings in which:

BRIEF DESCRIPTION OF THE DRAWINGS

FIG. 6 is a front elevation view of another embodiment of the invention.

FIG. 7 is a perspective view of another embodiment of the invention.

FIG. 8 is an enlarged view in the direction of arrows 8—8 in FIG. 7.

FIG. 9 is an enlarged partial front elevation section view along the centerline of the upper portion of the invention as shown in FIG. 6.

FIG. 10 is a section view in the direction of arrows 10—10 in FIG. 8.

DETAILED DESCRIPTION OF THE INVENTION

Figure 1:
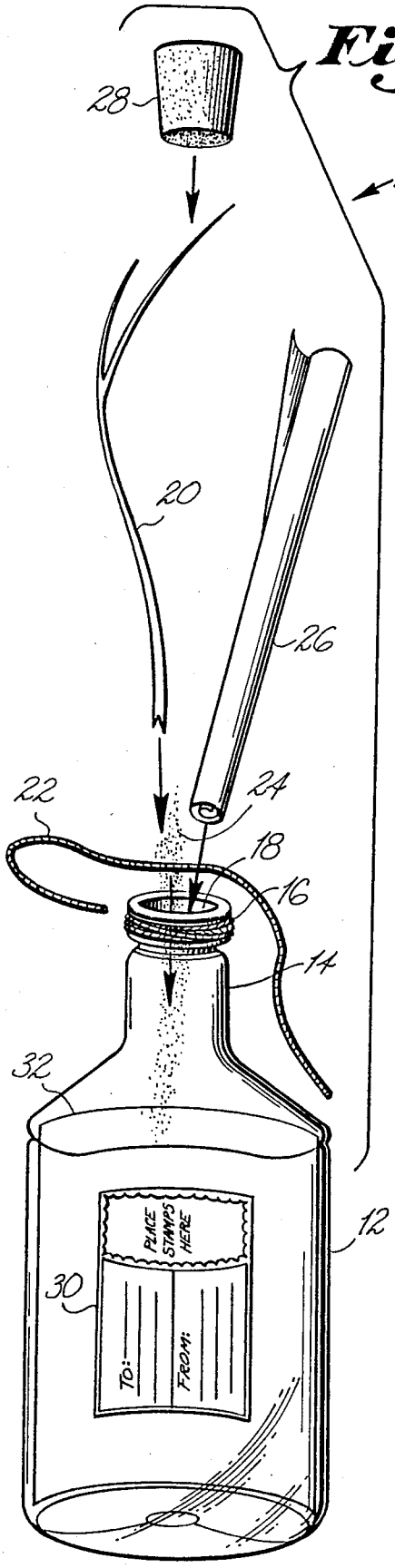
FIG. 1 is an exploded perspective view of the preferred embodiment of the invention.

Referring now to the drawings and particularly to FIGS. 1–4, the preferred embodiment of the invention is shown generally at 10 and includes a container 12 fabricated of thin-wall transparent shatterproof molded plastic material including a neck portion 14 forming an opening 18 at its distal end. Surrounding the neck protion 14 adjacent the opening 18 is a series of coils 16 of cord added primarily for decorative purposes, but also aiding in gripping the container 12 during closure.

In preparation for mailing or shipping the novelty mailer 10, a written message 26 and/or a small parcel (not shown) is prepared and deposited into the container 12 through opening 18. Also to be deposited in the container (or for merchandising purposes, already contained therein) are a variety of decorative materials 20, 22, and 24 which form the decorative portion of the contents of the novelty mailer 10. In the example shown, the decorative materials are in the form of sea weed 20, fishing line 22 and sand 24 which are indicative of the region of Florida.

After these contents are within the container 12, stopper 28 is inserted into opening 18 securely to prepare the novelty mailer 10 for shipment. In that regard, a mailing label 30 is also provided either ready for connection or already connected to the outer surface of the mailer ready to receive the mailing information desired.

Also contained preferably on the outer surface of the container 12 is a decorative label 32 which serves to enhance the novelty benefits of the mailer 10 and to further define the region from which the mailer 10 is mailed or shipped.

Figure 4:
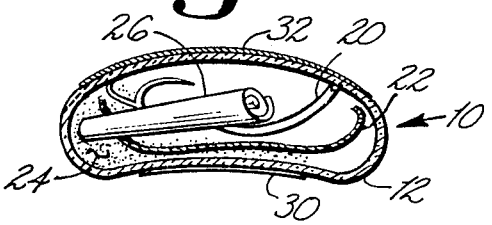
FIG. 4 is a section view in the direction of arrows 4—4 in FIG. 2.
Figure 2:
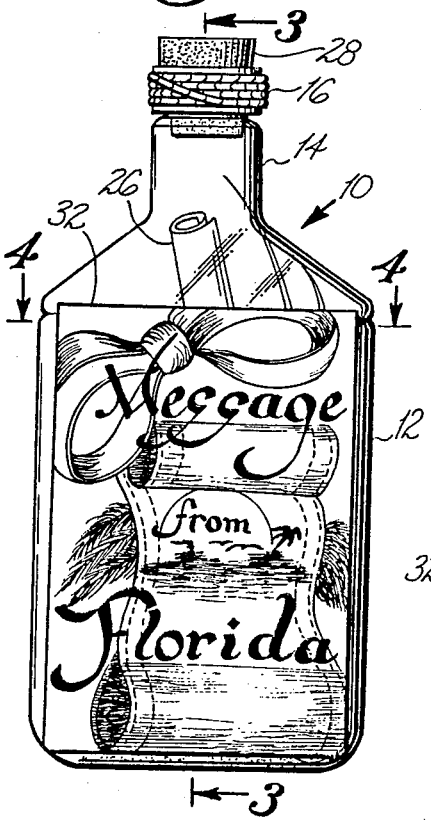
FIG. 2 is a front elevational view of FIG. 1 as assembled.
Figure 3:
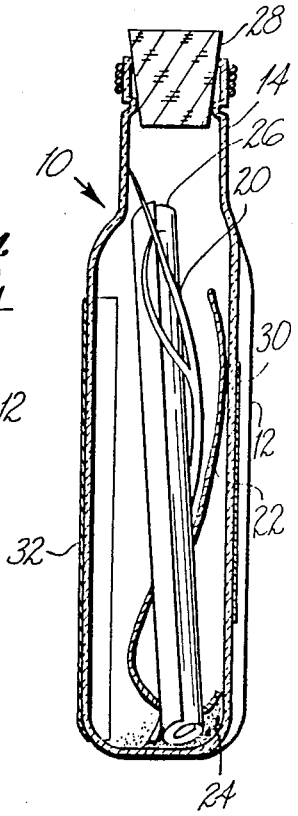
FIG. 3 is a section view in the direction of arrows 3—3 in FIG. 2.

As best seen in FIGS. 3 and 4, the preferred overall shape of the container 12 is somewhat flattened and may also be further contoured to suggest other or previous forms of use of the container 12 prior to mailing. The flattened structural feature is also intended to reduce the overall bulk of the novelty mailer 10 to facilitate shipping.

It is here emphasized that all embodiments of the container forming the novelty mailer are fabricated of thin-wall shatterproof material such as molded plastic to satisfy shippers' package requirements for safety and insurability.

Figure 5:
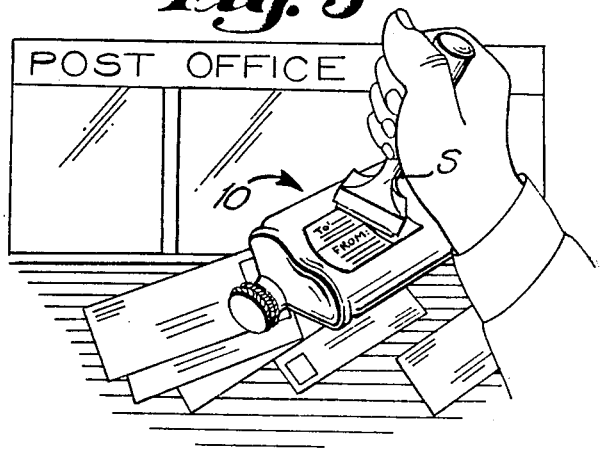
FIG. 5 is a pictorial view of the invention as shown in FIG. 1 being postmarked.

Referring now to FIG. 5, although the decorative label 32 may be positioned inside the container 12, the mailing label 30 must be adhered to the outer surface of the container so that it may be appropriately stamped or posted by marker S to insure and verify payment of shipping costs.

Referring now to FIGS. 6 and 9, another embodiment of the invention is shown generally at 40 and includes container 42 fabricated of thin-walled transparent shatterproof molded plastic material having a neck 44 forming an opening at its distal end into which stopper 52 may be inserted after the decorative contents 20 and 24, along with message 26, are placed therein. As previously described, decorative label 32' having a shape adapted to be adhered to the outer surface of container 42, is also provided, along with mailing label 30' to receive the appropriate mailing information and postage.

As best seen in FIG. 9, in addition to closing the opening of neck 44 with stopper 52, sealing cap 46 is also provided having sealing wire 54 embedded therein which surrounds and clenches the flexible sealing cap 46 to the enlarged distal end of neck 44 as shown. Thereafter, seal 50 is permanently locked in place on sealing wire portion 48 so that visible indicia will be provided whenever the novelty mailer 40 has been opened.

Referring lastly to FIGS. 7, 8 and 10, another embodiment of the invention is shown generally at 60 also including a container 62 fabricated of thin-walled transparent shatterproof molded plastic material and also having neck portion 64 extending to form opening 78 at its distal end. This embodiment 60 also includes hinged cap 66 pivotally connected along shaft 68 to a receiving boss formed in the neck portion 64 as shown. The cap 66 includes compressive sealing sheet 80 disposed at the bottom thereof such that, when cap 66 is pivoted into position over opening 78, the sealing sheet 80 sealingly engages the opening margin 84.

To secure hinged cap 66 in its closed position, locking wire 70, secured within mating cavity 76 formed in lid 66, serves to secure lid 66 in its closed position as follows. Grasping means 72, forming the distal ends of locking wire 70, may be forceably urged together in the direction of the arrows. thus causing side portions 74 to separate. Thereafter, when the lid 66 is rotated about shaft 68 to its closed position, the grasping means 72 are released and side portions 74 innerengage groove 82 formed into neck 64 as shown.

As previously described with respect to FIGS. 6 and 9, grasping means 72 may be sealingly secured apart so that visible indicia will be provided to show that they have been closed together to effect opening of the container.

While the instant invention has been shown and described herein in what is conceived to be the most practical and preferred embodiment, it is recognized that departures may be made therefrom within the scope of the invention, which is therefore not to be limited to the details disclosed herein, but is to be accorded the full scope of the claims so as to embrace any and all equivalent apparatus and articles.

What is claimed is:

1. A novelty mailer comprising:

a relatively thin-wall, substantially transparent, molded plastic, shatterproof container having a generally flattened shape to facilitate mailing;

an opening into the interior of said container disposed at one end thereof;

said opening forming a neck and sized to be relatively small compared to said container, whereby a bottle appearance is achieved;

decorations and a means for transmitting a message located in the interior of said container;

a closure means for releasably closing said opening after decorations and a message have been deposited into said container thus rendering said closed container mailable;

label means connectable onto said container adapted to receive written indicia identifying an addressee.

2. A novelty mailer as set forth in claim 1, wherein:

said closure means is a stopper adapted to fit snugly and sealably into said opening.

3. A novelty mailer as set forth in claim 1, wherein:

said decorations include materials indicative of a particular region.

* * * * *